United States Patent [19]

Chauve

[11] Patent Number: 4,890,843

[45] Date of Patent: Jan. 2, 1990

[54] BOARD GAME HAVING MASTER COURSE AND REGIONAL GAMES

[76] Inventor: Lionel Chauve, 75 Highland Ave., Glen Cove, N.Y. 11542

[21] Appl. No.: 129,378

[22] Filed: Nov. 24, 1987

Related U.S. Application Data

[63] Continuation of Ser. No. 878,192, Jun. 25, 1986, abandoned.

[51] Int. Cl.[4] ..... A63F 3/00; A63F 3/08

[52] U.S. Cl. ..... 273/246; 273/256; 273/254; 273/274; 273/244; 273/245

[58] Field of Search ..... 273/243, 244, 256, 274, 273/251, 252, 253, 254, 246

[56] References Cited

U.S. PATENT DOCUMENTS

| | | | |
|---|---|---|---|
| 3,356,369 | 12/1967 | Stubbmann | 273/249 |
| 3,658,336 | 4/1972 | Knapp | 273/244 |
| 3,889,954 | 6/1975 | Malisow | 273/274 X |
| 3,933,355 | 1/1976 | Pearce | 273/244 |
| 4,089,527 | 5/1978 | Roth | 273/249 |
| 4,127,273 | 11/1978 | Bonvetti, III | 273/245 |
| 4,484,749 | 11/1984 | Charney | 273/254 |

FOREIGN PATENT DOCUMENTS

| | | | |
|---|---|---|---|
| 277689 | 8/1964 | Australia | 273/251 |
| 801964 | 9/1958 | United Kingdom | 273/243 |
| 1384848 | 2/1975 | United Kingdom | 273/244 |

*Primary Examiner*—Edward M. Coven
*Assistant Examiner*—Benjamin Layno
*Attorney, Agent, or Firm*—Grimes & Battersby

[57] ABSTRACT

A board game having a master course forming a path about the board and subdivided into spaces associated with different geographical locations along which the players advance by rolling a die or dice. At least some of the spaces of the master course designate the site of a regional game which can be played by the player who lands on the space designating the site by taking one or more additional turns. Each regional game is independent of the master course in that the player cannot progress from the master course onto the seqeuence of spaces defining the regional game but can take additional turns to play the regional game while remaining on the space of the master course designating the site of the regional game.

9 Claims, 6 Drawing Sheets

FIG. 2A
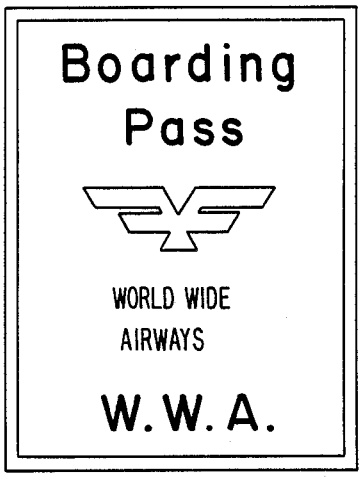
FIG. 3A
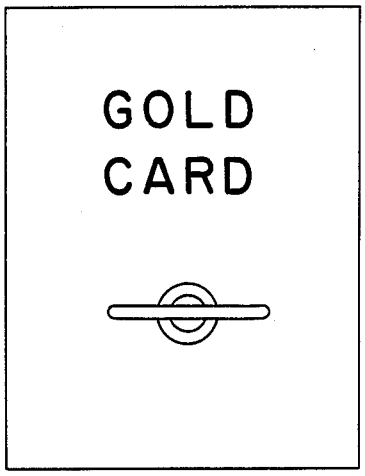
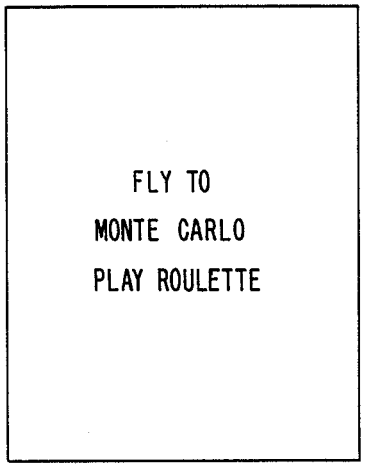
FIG. 2B
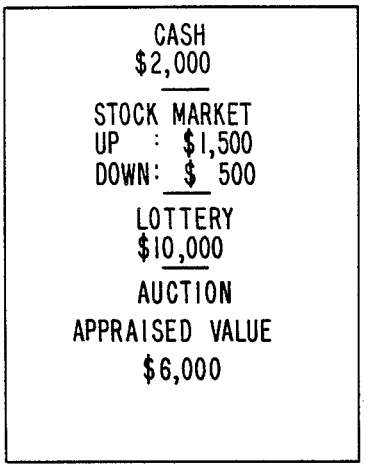
FIG. 3B

BOARD GAME HAVING MASTER COURSE AND REGIONAL GAMES

This application is a continuation of application Ser. No. 878,192, filed on June 25, 1986 now abandoned.

BACKGROUND OF THE INVENTION

This invention relates to board games and, more particularly, to a board game having a master course subdivided into a sequence of spaces from a starting point to a finishing point, a plurality of regional games along the master course adjacent at least one space of the master course, said regional games including numbered spaces defining a game board or course, and numbered means operated by a player to direct the player to advance a specified number of spaces along the master course and for playing the regional games. As the players pursue their journey along the master course, they have an opportunity to play a regional game associated with their location along the master course.

In a preferred embodiment of the present invention, many of the spaces of the master course are associated with different geographical locations, for example, countries, cities, or places or events associated with geographical locations. At certain of the locations along the master course, the player has an opportunity to participate in an activity associated with the region, such as the sweepstakes at Ireland, golf at Palm Springs, tennis at Bermuda, skiing at Aspen, gambling at Cannes, bidding at an auction at Paris, or playing the stock market at Toronto, thereby providing a diversion for the players as they journey along the master course from the starting point to the finishing point.

The progress of each player along the master course is determined by a numbered means operated by the player, for example, the throw of a die or dice or the spinning of a wheel. The numbered means is also used by the player in playing the regional games.

In a preferred embodiment of the invention, the object of the game is to accumulate cash and become the wealthiest player. The player's luck at each of the regional games along the master course determines the player's success or failure.

One or more decks of cards may be provided to assign a reward or penalty to a player or to permit the player to journey to another region to play the regional game. At various spaces along the master course the player will be instructed to pick a card from a specified deck.

The board game includes tokens assigned to players to locate their positions along the master course and chips assigned to the players to locate their positions on the spaces of the regional games.

For a complete understanding of the invention, reference can be made to the detailed description which follows and to the accompanying drawings, in which:

BRIEF DESCRIPTION OF THE DRAWINGS

FIG. 1-1 is the first quadrant of the face of the board; FIG. 1-2 is the second quadrant of the face of the board which connects to FIG. 1-1; FIG. 1-3 is the third quadrant of the face of the board which connects to FIG. 1-2; and FIG. 1-4 is the fourth quadrant of the face of the board which connects to FIG. 1-3.

FIGS. 2A and 2B are views of opposite faces of a card which directs the player to journey to a different position along the master course;

FIGS. 3A and 3B are views of opposite faces of a card which rewards or penalizes the player;

FIG. 4 is an elevational view of a token assigned to each player to locate his position on the master course.

DESCRIPTION OF THE PREFERRED EMBODIMENT

Figure 1:
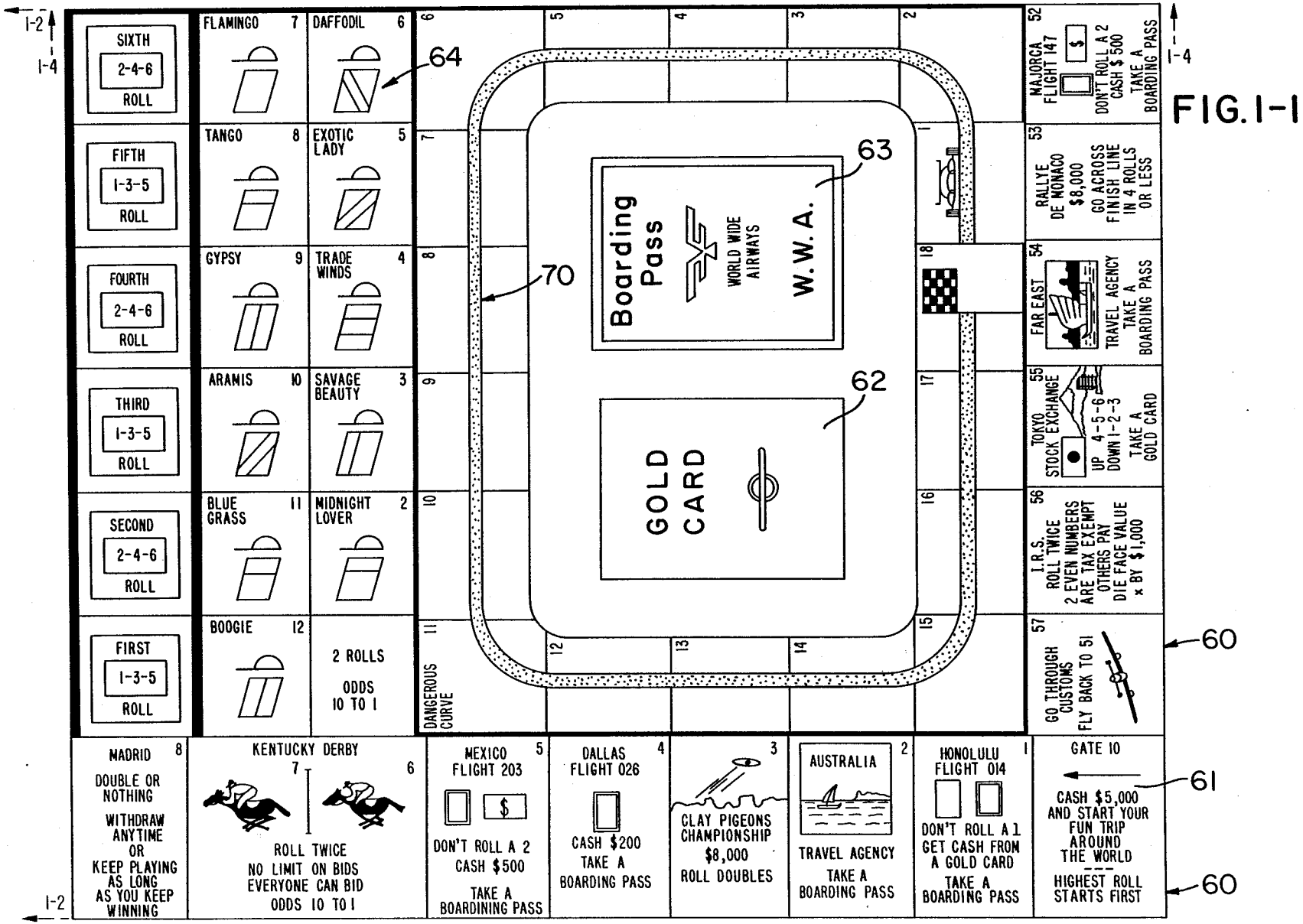
FIG. 1, which consists of FIGS. 1-1 through 1-4 connected together, is a plan view of the face of the board.
Figures 1, 2:
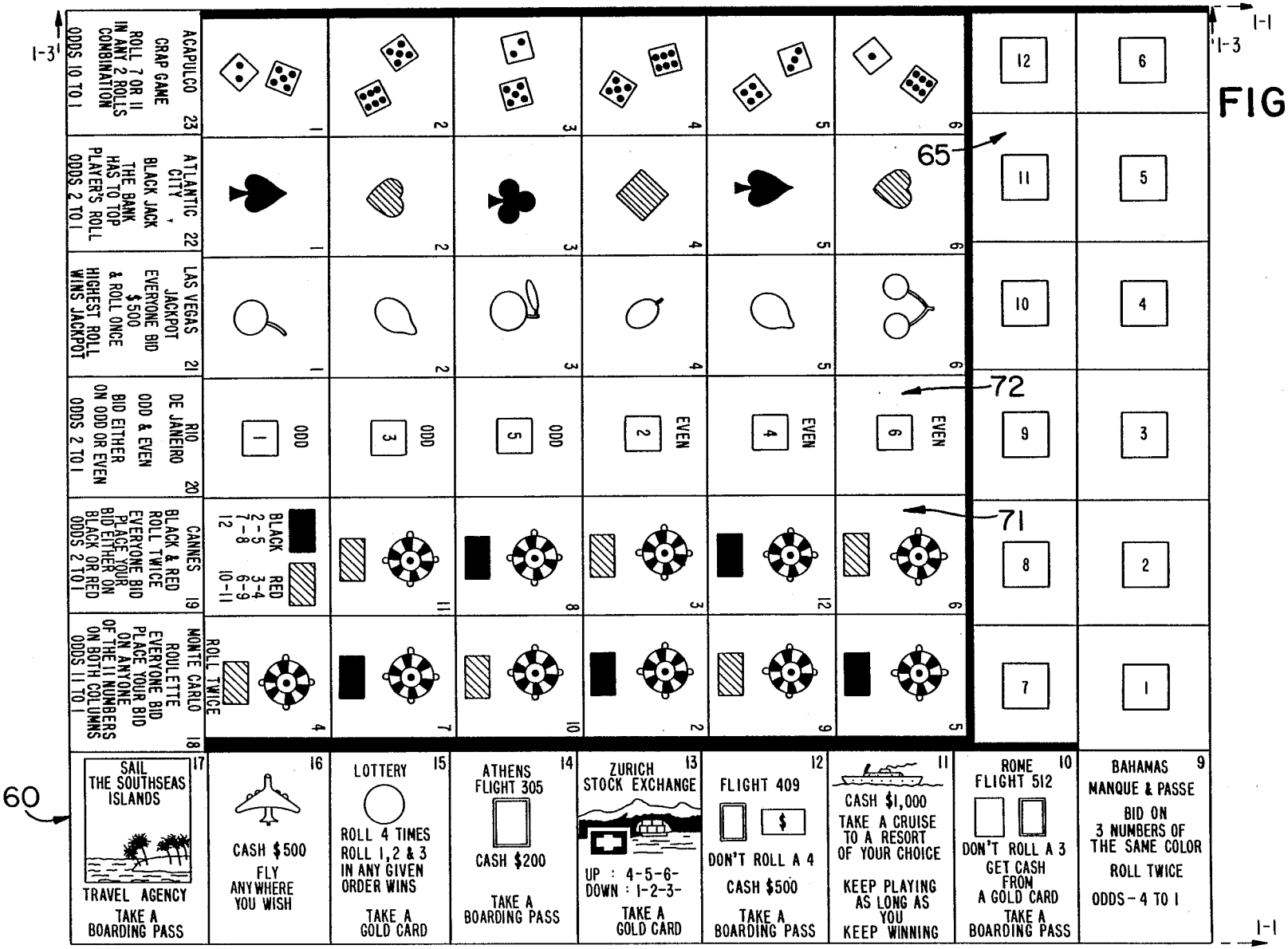
Figures 1, 2, 3:
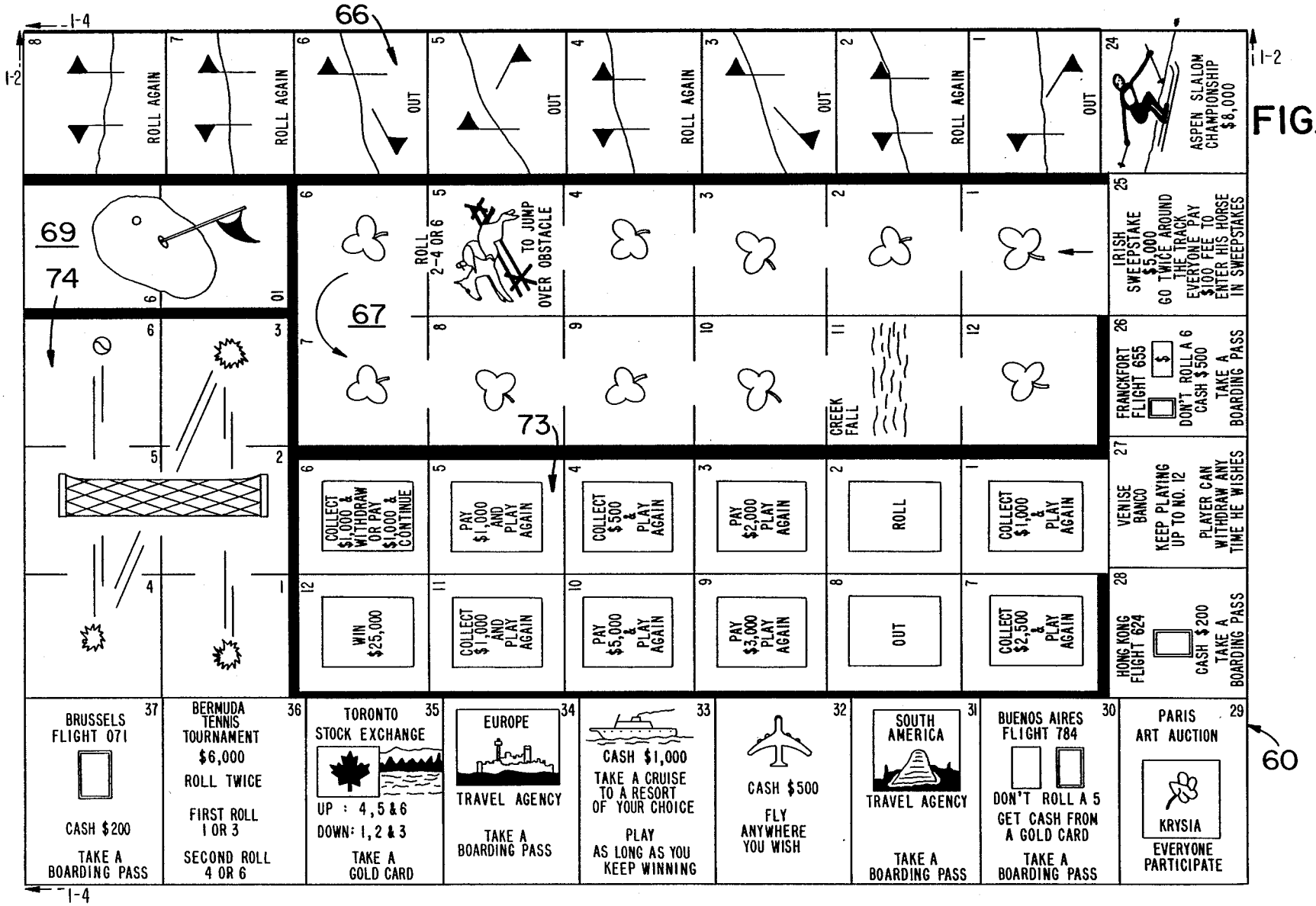
Figures 1, 2, 3, 4:
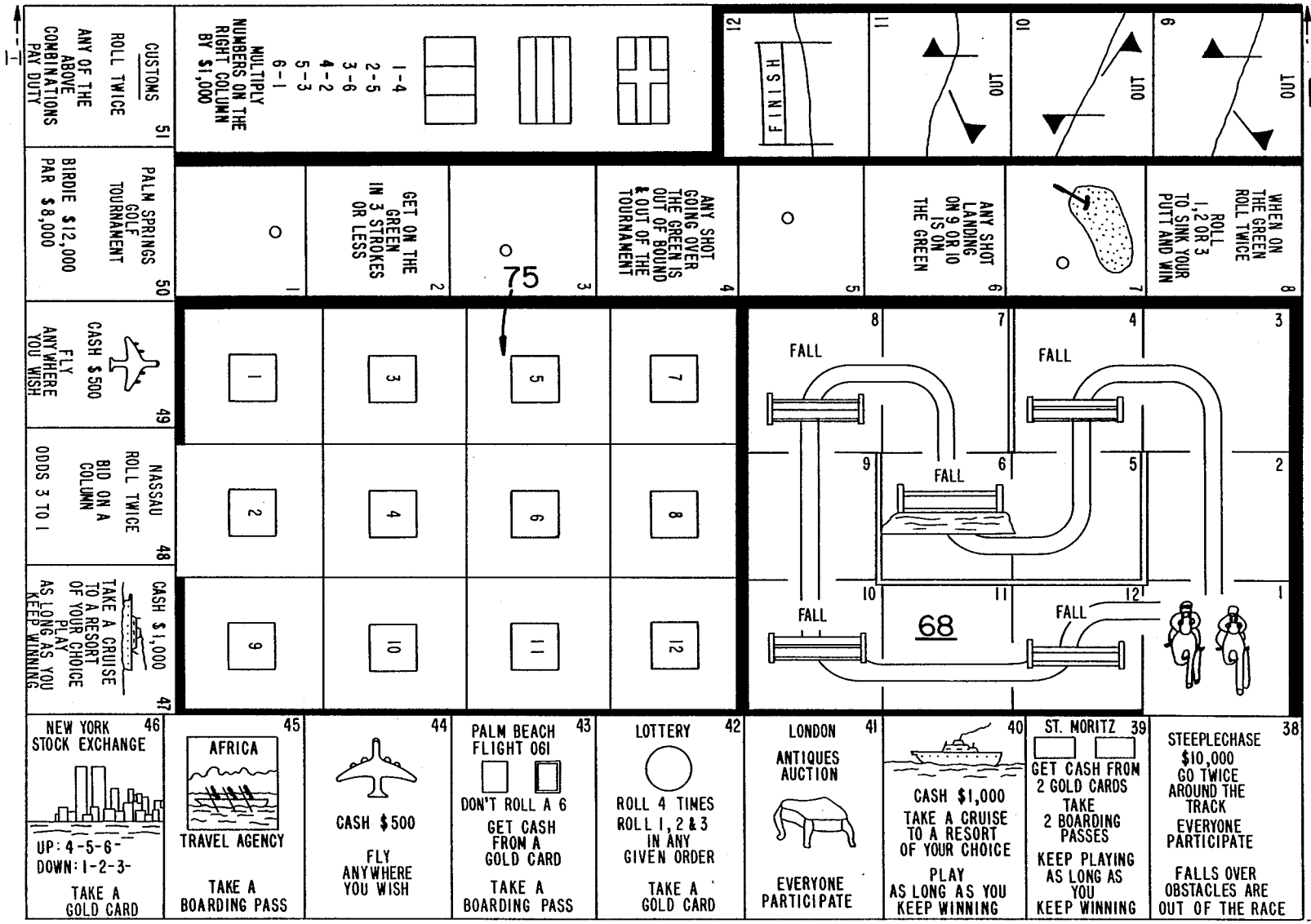
Figure 4:
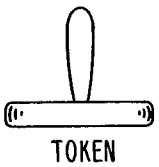
Figure 5A:
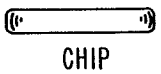
FIGS. 5A and 5B are plan and elevational views, respectively, of a chip assigned to each player to locate his position on one of the spaces of a regional game.
Figure 5B:
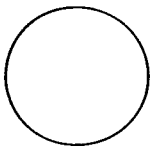

The board game of the present invention in its preferred embodiment includes: the game board shown in FIG. 1; a deck of cards referred to as "boarding passes," one of which is shown in FIGS. 2A and 2B; a deck of cards referred to as "gold cards," one of which is shown in FIGS. 3A and 3B; a plurality of different colored tokens, one of which is shown in FIG. 4; a plurality of different colored chips, one of which is shown in FIGS. 5A and 5B; a die or pair of dice (not shown); and play money (not shown) of different denominations.

The board has a sequence of spaces numbered 1 to 57 around the outer perimeter of the board. This sequence of spaces defines a master course 60. A corner space 61 designated "Gate 10" is the starting point and the finishing point of the master course. The fifty-seven numbered spaces which make up the master course are designated by different geographical locations (e.g., Honolulu, Australia), activities or events associated with different geographical locations (e.g., Kentucky Derby, Irish Sweepstakes), and symbols designating travel (e.g., airplane, ship).

There is an area 62 on the board for the deck of gold cards and an area 63 for the deck of boarding passes. Some of the spaces which make up the master course require the player to journey to a region to play the regional game without changing his position along the master course. Some of the spaces along the master course direct the player to take a gold card, which will reward or penalize the player in cash.

All of the spaces along the master course direct the player to receive or pay out cash, take a boarding pass or gold card, or participate in a regional game of chance. Many of these games of chance include a board or course of numbered spaces adjacent the master course, with the entry to the regional game adjacent a space of the master course associated with the region.

Some of these regional games are betting boards for one or all of the players. For example, adjacent spaces 6 and 7 designated "Kentucky Derby," there is a horse race betting board 64 composed of two columns of six spaces each. All of the players place their chips on the spaces identifying the horses of their selection. At space 9, entitled "Bahamas," there is a dice board 65 composed of twelve numbered spaces for play only by the player at that location.

In some of the regional games, the sequence of spaces defines a course or track along which a player advances his chip according to the roll of a die. For example, at space 24 entitled "Aspen Slalom Championship," there is a ski course 66 composed of a sequence of thirteen spaces from a start position on the master board to a finish position. At space 25 entitled "Irish Sweepstake," there is a track 67 in the form of a sequence of twelve spaces. At space 38 entitled "Steeplechase," there is a steeplechase course 68 composed of twelve spaces numbered in sequence. At space 50 entitled "Palm Springs Golf Tournament," there is a golf course 69 composed of a sequence of ten spaces from a tee off space to the 18th hole. At space 53 entitled "Rallye de Monaco," there is a track 20 composed of fourteen spaces around the areas 62 and 63 for the card decks.

PLAYING THE GAME

©1986 by Lionel Chauve

OBJECT OF THE GAME

The object of the game is to become the wealthiest player while traveling to exotic places all around the world. Along his travels a player will participate in regional games and activities, such as gambling, golf, tennis, playing the stock market and bidding at auctions.

THE CARDS, TOKENS AND CHIPS

The decks of gold cards and boarding passes are placed face down on their respective areas 62 and 63 on the board. Each player chooses a token and a chip of the same color. The token will be used on the spaces around the board to locate a player's position along the master course. The chip is used on the spaces of the boards or courses at the regional games.

THE MONEY

Each player will receive $5,000 in the following denominations: 10 $100 bills, 4 $500 bills, and 2 $1,000 bills.

THE BANKER

The banker can either be a player or someone not playing the game.

THE BANK

The bank has all of the money not distributed to the players, for example, an amount in the order of $1,000,000. The bank will pay out all moneys won at the regional games and any amounts specified on the playing board and on the gold cards.

THE GOLD CARDS AND BOARDING PASSES

The gold card is a credit card, and when awarded to a player it will ordinarily entitle a player to the specified amount of money from the bank. A player landing on a space reading "Get cash from a Gold Card" will receive from the bank the amount of money printed under "cash." There are three other categories on a gold card, namely, "auction," "stock exchange" and "lottery" and these will be explained below. The amounts of money differ from card to card.

The boarding passes permit a player to travel from one region to another to play the regional game while retaining his position on the master course. For example, if the boarding pass reads "Fly to Venice No. 27 and play Banco," the player takes his chip and goes to the Venice Casino to play Banco. When he resumes play, he returns to the space occupied by his token.

When taking either a gold card or boarding pass, a player must take the top card of the deck and return it face down at the bottom of the deck.

START OF PLAY

Each player throws a die and the player with the highest number plays first. The play starts on the corner 61 marked "Gate 10." The player throws the die and moves his token the number of spaces indicated by the die. After he has completed his play, the turn to play goes to the player at his left. All plays are single throws except when the board instructs the player to roll more than once.

DURATION OF GAME

A game will take players at least once around the board or until the bank goes broke. The players can decide among themselves the amount of turns around the board they wish to play. The players who have completed the specified number of trips around the master course continue to to play until the last player has completed the specified number of trips.

THE PLAY AROUND THE BOARD

SPACE NO. 1—HONOLULU: "Don't roll a 1—Get specified cash from a Gold Card.—Take a boarding pass."

The player must roll any number other than 1 on the die to avoid paying a penalty. If he rolls 1, he must pay $1,000 to the bank. When he has paid the penalty, or if he has rolled a number other than 1, the player takes a gold card and collects the amount specified under "cash." He then takes a boarding pass and plays the regional game.

SPACE NO. 2—AUSTRALIA: "Travel Agency—Take a boarding pass."

The player takes a boarding pass and plays the regional game.

SPACE NO. 3—CLAY PIGEON CHAMPIONSHIP

The objective is for the player to hit two clay pigeons sent up in the air simultaneously with two shots. To achieve this objective and win the championship, the player must roll a die twice to the same number, i.e., 1 and 1, 2 and 2, 3 and 3, etc.

SPACE NO. 4—DALLAS: "Cash $200—Take a boarding pass."

The player receives $200 from the bank, takes a boarding pass and plays the regional game.

SPACE NO. 5—MEXICO: "Don't roll a 2—Cash $500—Take a Boarding Pass."

If the player rolls a 2, he must pay $2,000 to the bank. When he has paid the penalty, or if he has rolled a number other than 2, the player takes a boarding pass and plays the regional game to which he is sent.

SPACES NO. 6 & NO. 7—KENTUCKY DERBY: "Every one can bid—No limits on bids—Roll twice—Odds 10 to 1."

All players can place a bet along with the player who landed on spaces 6 or 7. Each player places his chip on one of the numbered spaces on the board 64. Players can bet on the same number. Each player can elect how much he will bet. The player who landed on the Kentucky Derby spaces throws the die twice and the total of the two rolls determines the winner. Each winner receives ten times the amount of his bet from the bank.

SPACE NO. 8—MADRID: "Double or Nothing"

The player landing on this space bets any amount and he must roll alternately odd and even numbers on the die. He doubles his money on each successful roll and loses all to the bank on any unsuccessful roll. The player must decide before each throw whether to let his winnings ride or to take his winnings and withdraw.

SPACE NO. 9—BAHAMAS: "Manque & Passe—Bid on 3 numbers of the same color—Roll twice—Odds 4 to 1."

The numbers on the board 65 are one of four colors. The player landing on this space makes a bet and places his chip on one of the three numbers of the same color. He then throws the die twice and adds the total of the two rolls. If the winning number is among one of the numbers of the same color, the bank will pay four times the amount of the bid. If not, the bank collects the bet.

SPACE NO. 10—ROME: "Don't roll a 3—Get cash from a Gold Card—Take a Boarding Pass."

Same rules as for No. 1, except that if the player rolls 3 he will pay $3,000 to the bank.

SPACE NO. 11—CASH $1,000: "Take a cruise to a resort of your choice. Keep playing as long as you keep winning."

The player landing on this space receives $1,000 from the bank and goes anywhere on the board to play the regional game of his choice, where he can play as long as he keeps winning.

SPACE NO. 12— DON'T ROLL 4: "Cash $500—Take a Boarding Pass."

Same rules as for No. 5, except that the player must pay $4,000 to the bank if he rolls 4.

SPACE NO. 13— ZURICH STOCK EXCHANGE: "Up 4, 5, 6—Down 1, 2, 3. Take a Gold Card."

The player rolls the die and takes a gain with 4, 5 or 6 and a loss with 1, 2 or 3. The amount of the gain or loss can vary from $100 to $2,000 and the amount is shown under "stock market" on the gold card. The gain is received from the bank and the loss is paid to the bank.

SPACE NO. 14— ATHENS: See space No. 4.

SPACE NO. 15— LOTTERY

The player wins the lottery if he rolls 1, 2 and 3 in any order in four rolls of the die. The amount of the lottery is shown on the gold card and is paid by the bank.

SPACE NO. 16—CASH $500—FLY ANYWHERE YOU WISH The player receives $500 from the bank and plays the regional game of his choice.

SPACE NO. 17: See space No. 2.

SPACE NO. 18—MONTE CARLO— ROULETTE

Everyone bids on any one of the eleven numbers on both columns. Roll twice—odds 11 to 1.

Each player places his chip on any of the eleven numbers on board 71 and bets any amount. Players can bet on the same number. The player who landed on Monte Carlo rolls the die twice. The total of the two rolls is the winning number. The bank pays eleven times the amount of the winning bet and collects the losing bets.

SPACE NO. 19—CANNES: "Black & Red—Everyone bid—Odds 2 to 1."

The board 71 has red and black windows. Each player places his chip on any number with a black window or on any number with a red window and makes his bet. The player who landed on Cannes throws the die twice. The total of the two rolls determines the winning color. The bank pays twice the amount of the bet.

SPACE NO. 20—RIO DE JANEIRO: "Odds & Even—Odds 2 to 1."

The board 72 has six numbered spaces, with odd numbers having white windows and even numbers having yellow windows. The player bets odd or even. If the player wins, the bank pays him twice the amount of his bet. If the player loses, the bank collects the bet.

SPACE NO. 21—LAS VEGAS—JACKPOT: Everyone play.

Each player puts $500 into the jackpot. The player with the highest roll wins the jackpot.

SPACE NO. 22— ATLANTIC CITY: "Blackjack—Odds 2 to 1."

The player makes a bet, and the player and the bank roll the die. The higher roll is the winner. In the event of a tie, both roll again. The bank then pays the winner twice the amount of the bet and collects the bet if the player loses.

SPACE NO. 23—ACAPULCO: "Crap Game—Roll 7 or 11 in any two-roll combination. Odds 10 to 1."

When landing on this space, a player makes his bet, and throws the die twice. The total of the two rolls must be 7 or 11 to win. The bank pays ten times the amount of the bet.

SPACE NO. 24—ASPEN SLALOM CHAMPIONSHIP

To win the Aspen ski slalom, a player has to complete the twelve space course 66 and reach or pass the finish line without landing in a flag down space. If any throw of his die takes him to a space with a flag down, he is out of the ski championship.

SPACE NO. 25—IRISH SWEEPSTAKE

Everyone pays a $100 fee to enter the Irish Sweepstake. The race is run twice around the twelve space track 67. The highest roll starts first. A player who lands on space 5 has to roll 2, 4 or 6 on his next throw to advance over the obstacle. A horse which falls in the creek space 11 is out of the race. The first horse which traverses the track twice wins the race. The winner gets the purse money of $5,000 from the bank, plus the entry fees.

SPACE NO. 26—FRANKFURT

Same rules as for No. 12, except the player must pay $6,000 to the bank if he rolls 6.

SPACE NO. 27—VENICE BANCO

To win the Banco of $25,000, the player must traverse the numbered board 73 and land his chip on space 12. If the player overshoots space 12, he is out of the game. A player who lands on spaces 1, 4, 7 and 11 collects the specified amount and can elect to keep playing or withdraw. A player who lands on space 2 rolls again. A player who lands on spaces 3, 5, 9 and 10 has a choice either to withdraw or to pay the specified amount to keep playing. A player landing on space 6 can elect to take $1,000 and withdraw, or pay $1,000 and continue. A player landing on space 8 is out. A player landing on space 12 wins the $25,000 Banco.

SPACE NO. 28—HONG KONG: See Space No. 4

SPACE NO. 29—PARIS ART AUCTION: Everyone participates.

When a player lands on the Paris or London Auction (Space No. 41), he becomes the Auctioneer and has to try to have the other players bid on a painting or a piece of furniture and get the maximum bid.

Example: "We have here a painting by the renowned American floral artist Ketsia, the bid for this beautiful art piece starts at $1,000—who bids $1,500? I have a bid for $1,500—who bids $2,000? I have $2,500 on the left, I have $3,000, $3,500 . . . $4,000. Who bids $5,000—looking for $5,000, etc. . . . $4,000 was the last bid . . . $4,000 once . . . $4,000 twice . . . sold for $4,000."

The player making the highest bid pays the Auctioneer, takes a gold card and looks under "Auction" for the "appraised value." The bank pays the "appraised value".

SPACE NO. 30—BUENOS AIRES: See Space No. 1.

SPACE NO. 31—SOUTH AMERICA: Travel Agency. See Space No. 2.

SPACE NO. 32—CASH $500: Fly Anywhere you wish. See Space No. 16.

SPACE NO. 33—CASH $1,000: Take a cruise to a resort of your choice. See Space No. 11.

SPACE NO. 34—EUROPE: Travel Agency. See Space No. 2.

SPACE NO. 35—TORONTO STOCK EXCHANGE: See Space No. 13.

SPACE NO. 36—TENNIS TOURNAMENT: "Roll twice, first roll a 1 or a 3; second roll a 4 or a 6."

The player landing on this space plays on the court 74 and rolls the die twice. On his first throw he must roll either 1 or 3 to win the first set and stay in play. A roll of 2 hits the net and is out. A roll of 4, 5 or 60 is out. To win the tournament the player must roll 4 or 6 on his second throw. A roll of 5 hits the net and is out. A roll of 1, 2 or 3 is out.

SPACE NO. 37—BRUSSELS: See Space No. 4.

SPACE NO. 38—STEEPLECHASE: Everyone participates.

The race is run twice around the track 68. The player who lands on the Steeplechase space starts first, then the play passes to the left. Any player landing in a space with a "fall" obstacle is out of the race. The winner collects the purse of $10,000 from the bank.

SPACE NO. 39—ST. MORITZ

The player takes two gold cards and collects the "cash" from the bank. He then takes two boarding passes and plays the regional games in sequence for as long as he wants, provided he keeps winning.

SPACE NO. 40—TAKE A CRUISE: See Space No. 11.

SPACE NO. 41—LONDON ANTIQUES AUCTION: See Space No. 29.

SPACE NO. 42—LOTTERY: See Space No. 15.

SPACE NO. 43—PALM BEACH: See Space No. 1.

SPACE NO. 44—FLY ANYWHERE YOU WISH: See space No. 16.

SPACE NO. 45—TRAVEL AGENCY - AFRICA: See Space No. 2.

SPACE NO. 46—NEW YORK STOCK EXCHANGE: See Space No. 13.

SPACE NO. 47—TAKE A CRUISE: See Space No. 11.

SPACE NO. 48—NASSAU: "Bid on a column—Odds 3 to 1."

A player landing on this space makes his bet and places his chip on the three column board 75 at the bottom of the column of his choice. He rolls the die twice. The total of the two rolls gives the winning number. If the winning number is in the column of his choice, the bank pays three times the amount of the bet. If the winning number is not in the column of his choice, the bank collects the bet.

SPACE NO. 49—FLY ANYWHERE YOU WISH: See Space No. 16.

SPACE NO. 50—PALM SPRINGS GOLF TOURNAMENT:

A player landing on this space faces the par four 18th hole of the golf course 69. The player must first land on the green (spaces 9 and 10) in two or three strokes (die throws). He must not overshoot the green, as any throw that will carry him past the green will be out of bounds and put him out of the game. Once on the green, the player is entitled to two strokes (two die throws) to roll 1, 2 or 3 to sink the putt. A player who takes two strokes (two die throws) to get on the green and one single putt (either 1, 2 or 3 in a single roll) has a birdie and wins a $12,000 purse. A player who takes two strokes to get on the green and two strokes to sink his putt, or who takes three strokes to get on the green and one single stroke to sink his putt, has a "par" and wins $8,000.

SPACE NO. 51—CUSTOMS

The player rolls twice. Any of the following combinations pays duty:

| | |
|---|---|
| 1 - 4 | 4 - 2 |
| 2 - 5 | 5 - 3 |
| 3 - 6 | 6 - 1 |

The first roll will necessarily be one of the numbers on the left column (from 1 to 6). To pass "duty free" (pay no custom), the player must not roll the second number of the combination on his second roll. The duty to be paid to the bank is calculated by multiplying the number of the right column by $1,000.

SPACE NO. 52—MAJORCA: See Space No. 5.

SPACE NO. 53—RALLYE DE MONACO

A player landing on this space must go once around the track 70 and cross the finish line in four throws or less. If he misses the curve in space 11 (a die throw landing on No. 11) he is out of the race.

SPACE NO. 54—TRAVEL AGENCY—FAR EAST: See Space No. 2.

SPACE NO. 55—TOKYO STOCK EXCHANGE: See Space No. 13.

SPACE NO. 56—I.R.S.

A player landing on this space throws the die twice. To be tax exempt, he must roll two even numbers. Any other combination pays taxes. The taxes are calculated by adding the two throws and multiplying the total by $1,000.

SPACE NO. 57: "Go through Customs, Fly back to No. 51."

A player landing on this space will go back to Space No. 51 and continue to play from that space.

The invention has been shown in a single preferred form and by way of example only, and many variations and modifications can be made therein within the spirit of the invention. The invention, therefore, is not intended to be limited to any specified form or embodiment, except in so far as such limitations are expressly set forth in the claims.

I claim:

1. A game in which the players seek to accumulate money comprising:

a game board having a master course and having a plurality of regional game courses, said master course subdivided into a first sequence of spaces and forming a path of progression about said game board, at least some of the spaces of the master course designating the site of a regional game course to be played when a player lands on that space;

said plurality of regional game courses for games of chance along the master course provide that a player can win sums of money, each regional game course including one of a plurality of second sequences of spaces, each of the plurality of second sequence of spaces being different than the first sequence of spaces of said master course, each regional game course defining a betting board or a regional game and having the first space of the sequence located adjacent the space of the master course designating the site of that regional game course, each regional game providing a complete discrete game separate from the game of the master course, means operated by a player to generate a number which directs the player to advance a specified number of spaces along the master course and, when on a space of the master course designating the site of the regional game course, to further generate at least one additional number which directs the player along the regional course or determines the player's success or failure at a regional betting board; and means to identify movement of the player along the master course and the regional game course.

wherein each regional game course is independent of the master course so that the player cannot progress in the master course until completion of the regional game course.

2. A game as set forth in claim 1 in which the spaces of the master course are associated with different geographical locations so that travel along the master course moves the player from one geographical location to another.

3. A game as set forth in claim 1 including a plurality of two types of tokens, one type for each player to locate the player's position along the master course, and the other type for each player to locate the player's position in the spaces of the regional game.

4. A game as set forth in claim 1 in which spaces of the master course direct the player landing thereon to select a card and including a deck of cards, said cards including boarding passes directing a player to play a designated regional game.

5. A game as set forth in claim 1, wherein one of said regional games is a sequence of spaces defining a race track in which at least one of the spaces designates a fall obstacle which puts a player landing on that space out of the race.

6. A board game comprising a board having a master course subdivided into a sequence of spaces from a start position, said master course forming a path of progression about the board, a plurality of regional games along the master course, at least some of th- spaces of the master course designating the site of a regional game, each regional game being associated with and located adjacent the space of the master course designating the site of that regional game, each regional game including a sequence of spaces defining a betting board or a regional course and in which one of the regional games is a sequence of spaces defining a golf hole from tee off to the hole, the tee off space being located adjacent the space of the master course designating that regional game, and means operated by a player to generate a number which directs the player to advance a specified number of spaces along the master course and, when on a space of the master course designating the site of a regional game, to further generate a number which directs the player along the regional course or determines the player's success or failure at a regional betting board.

7. A board game comprising a board having a master course subdivided into a sequence of spaces from a start position, said master course forming a path of progression about the board, a plurality of regional games along the master course, at least some of the spaces of the master course designating the site of a regional game, each regional game being associated with and located adjacent the space of the master course designating the site of that regional game, each regional game including a sequence of spaces defining a betting board or a regional course and in which one of the regional games is a sequence of spaces defining a ski slope from a start space to a finish space, at least one of the sequence of spaces designating that the player cannot complete the regional game, and means operated by a player to generate a number which directs the player to advance a specified number of spaces along the master course and, when on a space of the master course designating the site of a regional game, to further generate a number which directs the player along the regional course or determines the player's success or failure at a regional betting board.

8. A board game comprising a board having a master course subdivided into a sequence of spaces from a start position, said master course forming a path of progression about the board, a plurality of regional games along the master course, at least some of the spaces of the master course designating the site of a regional game, each regional game being associated with and located adjacent the space of the master course designating the site of that regional game, each regional game including a sequence of spaces defining a betting board or a regional course and in which one of the regional games is a sequence of spaces designating a tennis court with the sequence crossing and recrossing net spaces, and means operated by a player to generate a number which directs the player to advance a specified number of spaces along the master course and, when on a space of the master course designating the site of a regional game, to further generate a number which directs the player along the regional course or determines the player's success or failure at a regional betting board.

9. A board game comprising a board having a master course subdivided into a sequence of spaces from and returning to a start position and forming a path of progression about the board, a plurality of regional games located along the master course, each regional game being associated with and located adjacent a space of the master course designating the site of that regional game, at least one of such regional games the board, a plurality of regional games located along the master course, each regional game being associated with and located adjacent a space of the master course designating the site of that regional game, at least one of such regional games including a sequence of spaces defining a regional course forming a path of progression from a starting space of the regional game adjacent the space of the master course designating the site of the regional game to a last space of the regional course and in which the regional games include a horse race track, a golf hole and a ski slope, each having the starting space of the sequence of spaces defining the regional game located adjacent the space of the master course designating the site of the particular regional game, said regional game providing an activity for at least the player landing on the space of the master course designating the site of that regional game and affording the player an opportunity to win an award while the player is at the site of the regional game, and means operated by the players to generate numbers which direct the players to advance specified numbers of spaces along the master course and, when on spaces of the master course designating the sites of regional games, to generate numbers which direct the players to advance specified numbers of spaces along the regional courses.

* * * * *